United States Patent [19]

Cordier et al.

[11] 4,364,771

[45] Dec. 21, 1982

[54] PRODUCT FOR THE DESULPHURIZATION OF CAST IRONS AND STEELS

[75] Inventors: Jean Cordier, Dunkerque; Michel Demange, Le Fayet; Jean Idier, St. Beat, all of France

[73] Assignee: Societe Francaise d'Electrometallurgie SOFREM, Paris, France

[21] Appl. No.: 224,535

[22] PCT Filed: May 12, 1980

[86] PCT No.: PCT/FR80/00073

§ 371 Date: Jan. 17, 1981

§ 102(e) Date: Dec. 17, 1980

[87] PCT Pub. No.: WO80/02565

PCT Pub. Date: Nov. 27, 1980

[30] Foreign Application Priority Data

May 15, 1979 [FR] France ..... 79 13279

[51] Int. Cl.[3] ..... C21C 7/02

[52] U.S. Cl. ..... 75/58; 75/53

[58] Field of Search ..... 75/53, 58

[56] References Cited

U.S. PATENT DOCUMENTS

| | | | |
|---|---|---|---|
| 2,971,833 | 2/1961 | Artru | 75/10 R |
| 3,953,198 | 4/1976 | Easwaran | 75/58 |
| 3,957,502 | 5/1976 | Cull | 75/58 |
| 3,969,105 | 7/1976 | Ott | 75/58 |
| 3,998,625 | 12/1976 | Koros | 75/53 |
| 4,190,434 | 2/1980 | Bonfils | 75/24 |

FOREIGN PATENT DOCUMENTS

| | | |
|---|---|---|
| 1125154 | 7/1956 | France . |
| 1168646 | 9/1958 | France . |
| 1168750 | 9/1958 | France . |

*Primary Examiner*—P. D. Rosenberg

*Attorney, Agent, or Firm*—Dennison, Meserole, Pollack & Scheiner

[57] ABSTRACT

The invention relates to a process for the desulphurization of cast irons and steels.

The product is constituted of the combination of magnesium shot or magnesium alloy with rounded contours having a granulometry of between 0.1 and 3 mm and a granulated slag having a basicity index higher than 1, containing alumina, lime, silica and magnesia, and optionally an additional flux having a granulometry of between 0.1 and 3 mm in a proportion ranging from 90 to 10% and preferably from 80 to 20% of magnesium shot and from 10 to 90% and preferably from 20 to 80% of granulated slag.

Application to the desulphurization of forge pigs and foundry pig irons, to the nodularization of foundry pig irons by nozzle injection in a carrying gas stream into the liquid cast iron or steel.

15 Claims, No Drawings

PRODUCT FOR THE DESULPHURIZATION OF CAST IRONS AND STEELS

The present invention relates to a new product for the desulphurization of forge pigs and foundry pig irons, and of steels, and for the nodularization of foundry pig irons, the product being particularly suitable for direct injection, using a nozzle, in a current of carrier gas into the liquid cast iron or steel, and constituted of magnesium base shot combined with slag granules.

It is well known to treat cast iron and steel with magnesium or with magnesium base compositions, particularly for their desulphurization. However, this treatment is complicated by the low boiling point and the low density of this metal. When solid magnesium is added in various forms to the liquid cast iron or liquid steel, abrupt volatilization of this metal occurs, burning the surface and producing liquid cast iron spray. The reaction can be very violent. The technique of blowing magnesium into the liquid metal in which the magnesium which has been reduced into powder or sufficiently fine particles and is carried along by a current of carrier gas is also well known. It has the advantage of reducing the violence of the reaction and the spray while allowing the duration of addition to be increased as much as necessary. However, it does have the following problems which limit its use: (1) the very constant control of the very small flow of powdered magnesium is technically difficult to achieve; (2) the handling of magnesium powder either during transportation, or particularly in the injection apparatus, is unsafe due to the risk of sudden ignition; and (3) finally, the yield of the addition in the liquid metal is unstable. It can be seen that it is difficult to achieve uniform dissolution of the magnesium by this method.

A certain number of solutions which can be grouped into three categories have been proposed for overcoming these disadvantages.

In the first category, the magnesium is absorbed on a porous support such as coke (French Pat. No. 1,417,474 of American Cast Iron Pipe Company), or a porous ceramic material (French Pat. No. 1,357,511 of Foseco Trading A.G. or on an iron sponge (French Pat. No. 1,568,576 of Jarn foradling).

In the second category, the magnesium is mixed with a diluent which can also play a part in the desulphurization process such as lime (French Pat. Nos. 1,125,154; 1,168,646; 1,168,750 of the l'Institut de Recherches de la Siderurgie).

Finally, in the third category, the magnesium is coated with an inert substance (metallic oxides, halogenated salts).

These various processes have further disadvantages and they are not considered as completely satisfactory by steel manufacturers. Their disadvantages can be summed up as follows:

(i) irregularity and non-reproducibility of results; (ii) frequent blockage of the injection nozzles; (iii) violent reactions which are sometimes poorly controlled; (iv) environmental pollution if the magnesium shot is coated with chlorides; (v) difficult handling of the fine magnesium powder; (vi) very poor yield in the case of coated shot, because the coating usually disappears only at the moment when the magnesium comes to the surface of the cast iron where it burns without having reacted.

The present invention quite satisfactorily solves the problem of injecting magnesium into a bath of liquid cast iron or steel and ensures the safety of the personnel, the uniformity of operation and a minimal sulphur content yield, and simplifies handling.

It relates to a product for the desulphurization of cast irons and steels in the liquid state by injection through a nozzle in a carrier gas current, characterized in that it contains, in combination, from 10 to 90% of magnesium base shot and from 90 to 10% of granulated slag and preferably from 20 to 80% of magnesium base shot and from 80 to 20% of granulated slag, these percentages being expressed by weight.

The granulated slag can be obtained by granulation of slags of a particular composition, either by casting the molten slag into water optionally followed by a drying treatment then sifting, or by granulation in a jet of gas or "ball-making" on a pellitizing plate or cylinder which produces particles having rounded contours.

These slags have the following properties:

(a) they are compatible with metallurgical cast irons, steels and slags;

(b) they have a slight abrasive effect which allows internal scouring of the injection nozzle and thus prevents adhesion of the magnesium particles without causing excessive erosion;

(c) they have a desulphurizing effect which varies according to their composition;

(d) they also have noteworthy specific properties due to the granulated state which gives them their originality;

(e) the granulation allows a porous structure which gives these granulates an excellent thermal insulating capacity. This characteristic allows premature melting of the magnesium shot inside the injection nozzle to be avoided even in the case of mixtures containing a small proportion of slag (from 80 to 90% of magnesium shot and from 10 to 20% of granulates for example). They also prevent excessive heating of the internal walls of the nozzle and thus considerably increase their service life. Premature melting of the magnesium in the nozzle is a frequent cause of blockage. The thermal insulating properties and the abrasive effect of the slag granulates ensure very good reliability of injection.

(f) Their porous structure permits very low apparatus densities. Products are thus prepared with precise granulometry and an apparent density very close to that of the shot—particularly stable slag granulates which are free from grading during all the operations of handling, storage and injection even in a fluidized bed. This property guarantees very good homogeneity of the mixture and consequently very good uniformity of the results of desulphurization.

(g) The granulation also gives the slag granulates very good physical and chemical inertia during storage. The granulates do not disintegrate and are not hygroscopic. Conservation is greatly facilitated relative to mixtures containing lime.

(h) The granulates are also very solid and this guarantees their granulometric stability until they are used.

(i) The granulates whose individual mass is very much greater than that of the particles of finely powdered additives such as the lime allow the amount of movement, thus the kinetic energy, of the injected product to be increased and thus the penetration of the jet into the bath of cast iron or steel to be increased.

(j) Furthermore, the properties enumerated above allow the mixtures to be stored and handled under better safety conditions than the pure magnesium shot.

(k) The fusible slags which are used facilitate separation of the inclusions and of the sulphides originating from the action of the magnesium. They also facilitate skimming of the dross which has trapped the magnesium sulphide and protect the surface of the metal and the magnesium beneath it from oxidation.

Particularly suitable slags within the scope of the invention inlcude those of a basic character with an index of basicity higher than 1 and preferably higher than 2 which can contain, in addition to lime, alumina, silica and magnesia, one or more additional constituents such as calcium fluroides (fluor spar) or sodium fluorides, alkali metal oxides, alkali and alkaline earth metal borates which allow the melting point or the viscosity or any other physico-chemical characteristic to be adjusted. The basicity can be identified by the weight index $(MgO+CaO+Na_2O)/(SiO_2+Al_2O_3)$.

The magnesium shot can be obtained by any known method which gives to the particles a shape with rounded contours which is free from sharp edges and which is essential for ensuring that the product forming the object of the invention has good characteristics of flow in the pipes and in the injection nozzle. Suitable methods for obtaining these shapes include the crushing of chips or turnings or any other product of the removal of material, pulverization or atomization of liquid metal by spraying or by centrifuge.

The granulometry can be selected within relatively wide limits. In practice, a granulometry of between about 0.1 and 3 mm and preferably between 0.3 and 2 mm gives the best results at the stage of use of the desulphurizing or inoculating product.

In the majority of cases, the shot is constituted of nonalloyed magnesium containing the normal impurities. However, depending on the desired results, whether to facilitate the shaping of the magnesium in the state of shot or to impart particular properties to the cast iron or steel, it is also possible to use shots possibly containing in addition to the magnesium at least one element selected from aluminum up to 25% by weight, calcium up to 25% by weight, silicon up to 10% by weight, and one or more metals from the rare earth group or their so-called misch metal mixture from 0.1 to 10% by weight.

The desulphurizing or nodularizing product forming the object of the invention contains proportions of granulate and of slag which vary depending on the applications. For example, if the desulphurization of a "haematite" forge pig iron is considered, it is known that the operation must not last more than 6 to 8 minutes for various reasons. Taking into consideration the initial content and the final content of sulphur desired and the yield of magnesium and the flow rate of the injection nozzle, it is easy to calculate the theoretical quantity of magnesium needed and consequently to adjust the mixture. Thus, by adjusting the magnesium to slag ratio, it is possible to control the flow rate, the duration and the effectiveness of the desulphurizing injection operation. In practice, it has been observed that compositions ranging from 10 to 90% (by weight) of magnesium shot and from 90 to 10% of granulated slag allowed all the cases arising to be solved, the preferred compositions ranging from 20 to 80% of magnesium shot and from 80 to 20% of granulated slag.

The following examples allow some possible embodiments of the invention to be specified in a nonlimiting manner.

Slag granules of from 0.3 to 1.6 mm having the following composition by weight were used: $SiO_2$:25%; GaO:57%; $Al_2O_3$:12%; and MgO:6%, having a basicity index of 2.52.

This slag originates from the manufacture of magnesium by the "Magnetherm" process as described in French Pat. Nos. 1,194,556; 2,204,697; and 2,395,319.

The magnesium used was obtained by the same Magnetherm process with a magnesium content higher than 99.5% and a granulometry of from 0.3 to 1.6 mm.

The results are classified in Table 1.

They relate to the desulphurization of a haematite forge pig iron (nonphosphorous) in a 120 ton ladle.

In the event of the nodularization of foundry pig irons, the quantity of magnesium injected is substantially larger than that used during desulphurization, and can be as high as 1.5 kg per ton of cast iron.

The various advantages obtained by using the desulphurizing or inoculating product forming the subject of the invention include:

(1) the total elimination of any risk of ignition of the product during storage even when glowing cast iron or steel is sprayed. The ease of handling, the absence of any polluting effect, of any liberation of smoke or of harmful gases;

(2) the high reliability of the injection process, the elimination of the risks of blockage of the nozzles; the very good reproducibility of the operations due to the regulation and control of the injection period and of the stirring of the metal by adjustment of the relative proportions of magnesium shot and slag granules; the spectacular increase in the service life of the injection nozzles;

(3) excellent metallurgical results: achievement of very low desulphurization rates while maintaining very good yields of magnesium introduced, thus a guarantee of the most economic treatment depending on the initial sulphur content and the final sulphur content in the metal treated.

TABLE 1

| Examples | Desired Sulphur Content % | Initial S content of the cast iron % | Total S content after treatment % | Mg/slag ratio in the injected product % | Injection period in minutes | Thousand Mg per ton of cast iron in kg | Injection yield of Mg % |
|---|---|---|---|---|---|---|---|
| 1 | <0.008 | 0.030 | 0.005 | 60/40 | 6 | 0.385 | 75 |
| 2 | <0.005 | 0.025 | 0.003 | 80/20 | 8 | 0.453 | 71 |
| 3 | <0.018 | 0.035 | 0.015 | 20/80 | 6 | 0.232 | 83 |
| 4 | <0.005 | 0.035 | 0.003 | 80/20 | 8-9 | 0.527 | 76 |

N. B. The injection yield of the magnesium is defined as the ratio of the magnesium effectively dissolved in the cast iron (and which has reacted or has remained in solution in the cast iron) to the total magnesium injected and placed in contact with the cast iron.

We claim:

1. A product for the desulphurization of forge pigs and foundry pig irons and steels and for the nodularization of foundry pig irons intended to be injected by means of a nozzle in a current of carrier gas into the liquid cast iron or steel, characterized in that it contains, in combination, from about 10 to about 90% of magnesium shot and from about 90 to about 10% of an expanded porous granulated basic slag comprising, alumina, silica and magnesia having an index of basicity higher than 1.

2. A product according to claim 1, characterized in that it preferably contains from about 20 to about 80% of magnesium shot and from about 80 to about 20% of granulated slag.

3. A product according to claim 1 or 2, characterized in that the shot is constituted by nonalloyed magnesium.

4. A product according to claim 1 or 2, characterized in that the shot is constituted of a magnesium base alloy containing at least one element selcted from aluminum up to about 25% by weight, calcium up to about 25% by weight, silicon up to about 10% by weight, the metals from the rare earth group or misch metal from about 0.1 to about 10% by weight.

5. A product according to claim 1, 2, 3, or 4, characterized in that the shot is formed from particles having rounded contours with a granulometry of between 0.1 and 3 mm.

6. A product according to claim 5, characterized in that the shot is obtained by crushing chips or turnings.

7. A product according to claim 5, characterized in that the shot is obtained by pulverization of liquid metal.

8. A product according to claim 1 or 2, characterized in that the granulated slag is obtained by granulation of the liquid slag in water.

9. A product according to claim 1 or 2, characterized in that the granulated slag is obtained by granulation of the liquid slag in a jet of gas or steam.

10. A product according to claim 1 or 2, characterized in that the granulated slag is obtained by pelletization.

11. A product according to claim 1 or 2, characterized in that the granulated slag contains alumina, lime, silica and magnesia.

12. A product according to claim 11, characterized in that the granulated slag also contains at least one additional constituent selected from calcium fluoride, sodium fluoride, sodium fluoride, the alkali metal oxides, the alkali and alkaline earth metal borates.

13. A product according to one of claims 11 or 12, characterized in that the basicity index of the slag is at least 1.

14. A product according to any one of claims 9 to 13, characterized in that the slag has a granulometry of between 0.1 and 3 mm.

15. In a method for the desulphurization of forge pigs, foundry pig irons and steels and for the nodularization of foundry pig irons, the improvement comprising injecting into said forge pigs and said foundry pig irons and steels by means of a nozzle in a current of carrier gas from about 10 to about 90% of magnesium shot and from about 90 to about 10% of an expanded porous granulated basic slag having an index of basicity higher than 1 comprising as a major proportion lime and a minor proportion of additional constituents selected from the group consisting of alumina, silica, magnesia, calcium fluorides, sodium fluorides, alkali metal oxides, alkali earth metal borates and alkaline earth metal borates or a combination thereof.

* * * * *